United States Patent [19]

Parbhoo et al.

[11] 4,109,610

[45] Aug. 29, 1978

[54] TEXTILE SIZE APPLICATOR WITH A TEMPERATURE CONTROLLING FLUID

[75] Inventors: Kantilal R. Parbhoo, Reynoldsburg; Jerome P. Klink, Granville; John P. Calland, Pataskala; Gerald L. White, Newark, all of Ohio

[73] Assignee: Owens-Corning Fiberglas Corporation, Toledo, Ohio

[21] Appl. No.: 752,368

[22] Filed: Dec. 20, 1976

[51] Int. Cl.[2] ..... B05C 1/04

[52] U.S. Cl. ..... 118/202; 118/234; 118/420; 65/3 B

[58] Field of Search ..... 118/202, 203, 234, 259, 118/261, DIG. 20, 420, 101, 401; 68/200, 202; 65/3 R, 3 A, 3 B, 3 C, 11 R

[56] References Cited

U.S. PATENT DOCUMENTS

| | | | |
|---|---|---|---|
| 2,334,102 | 11/1943 | Kauppi | 118/101 |
| 2,577,132 | 12/1951 | Kivley | 118/234 X |
| 2,772,518 | 12/1956 | Whitehurst et al. | 65/3 B |
| 2,928,716 | 3/1960 | Whitehurst et al. | 65/3 B |
| 2,976,177 | 3/1961 | Warthen | 118/420 X |
| 3,268,312 | 8/1966 | Grant | 118/259 X |
| 3,272,177 | 9/1966 | Kelley | 118/202 |
| 3,393,661 | 7/1968 | Sharp | 68/202 X |
| 3,750,746 | 8/1973 | Norman | 118/202 X |
| 3,780,699 | 12/1973 | Kime | 118/420 |
| 3,827,395 | 8/1974 | Goettsch | 118/202 X |
| 3,827,397 | 8/1974 | Hebbenling et al. | 118/234 X |
| 3,980,043 | 9/1976 | Pomper | 118/259 X |

FOREIGN PATENT DOCUMENTS

| | | | |
|---|---|---|---|
| 1,070,123 | 1/1957 | Fed. Rep. of Germany | 118/261 |
| 46-42,059 | 12/1971 | Japan | 118/234 |

*Primary Examiner*—Mervin Stein
*Assistant Examiner*—Andrew M. Falik
*Attorney, Agent, or Firm*—Ronald C. Hudgens; Philip R. Cloutier; Ted C. Gillespie

[57] ABSTRACT

An applicator for applying a size to a strand comprises a reservoir for storing the size, an applicator surface on which the strand contacts the size, and a conduit to deliver the size from the reservoir to the applicator surface as a film. Means is provided for altering the configuration of the conduit to alter the thickness of the film.

5 Claims, 2 Drawing Figures

TEXTILE SIZE APPLICATOR WITH A TEMPERATURE CONTROLLING FLUID

Figure 1:
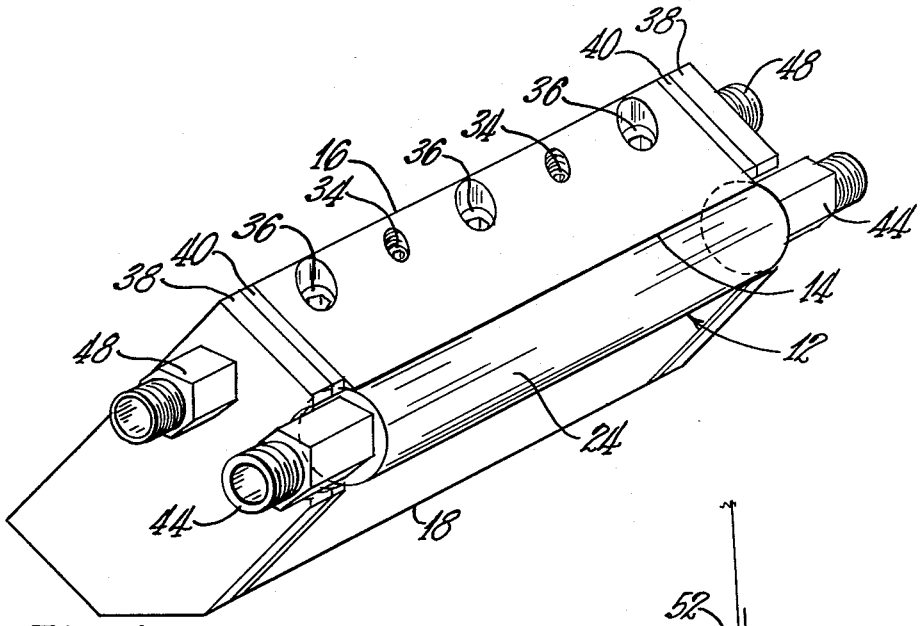

The present invention relates to the coating of strands. More particularly the present invention relates to apparatus for applying a size to a strand. The strand can consist of glass fibers, or can be comprised of fibers of other material such as other mineral materials or synthetic resin materials.

In strand sizing operations, it is commonplace for a size to be applied by spraying it onto the strand. Such a process has a disadvantage in that much of the airborne size fails to contact the strand and consequently is free to settle on the floor or process equipment. In a fiber operation, a portion of the size can potentially coat the fiber forming apparatus, thereby reducing the lifespan and the efficiency of such equipment. As an improvement in applying size to strands the strands can be brought into contact with an applicator surface, usually a rotating roller, upon which the size is applied. The size is usually applied as a thin film, and the strand becomes coated as it contacts the film on the applicator surface.

Various devices have been used to apply such a thin film to an applicator surface. For example, Russell in U.S. Pat. No. 2,895,789 uses an electrically heated applicator surface to melt and supply a thin film of metallic coating for strands. Hill et al. in U.S. Pat. No. 3,498,262 use a feed tube narrowing to thin slot to apply a thixotropic size to the backside of a rotating applicator roll.

One of the problems yet unsolved by the above applicators and by other applicators known in the art is that of controlling the thickness of the film of size on the applicator surface. It is sometimes desirable to change the thickness of the film of size to compensate for changes in the viscosity of the size, or for changes in the sizing operation or environment. There has now been developed an applicator in which the thickness of the film can be controlled by feeding the size through a relatively flat conduit and by altering the configuration of the conduit. There has also been developed an applicator in which the viscosity of the size is maintained constant as the size is applied to the strand.

According to this invention, there is provided an improved apparatus for applying a size to a strand. The apparatus includes a reservoir for storing the size, an applicator member having a surface upon which the strand contacts the size, a conduit means to deliver the size from the reservoir to the applicator surface as a film, and means for altering the configuration of the conduit means and thereby altering the thickness of the film. The conduit means can be defined by two opposed block members, the configuration of the conduit being alterable by varying the distance between the two block members. The applicators can be a non-rotational member.

In a preferred embodiment, one of the block members can be adapted with a set screw means, and the two block members can be urged towards each other by at least one bolt member. Also in a preferred embodiment, either one, or both, of the block members can contain a passageway for the passage of a temperature-controlling fluid.

In another preferred embodiment, the applicator surface is adapted with means to maintain the temperature of the size constant as the size is applied to the strand. The applicator member can contain a passageway for the passage of a temperature-controlling fluid. Where both the applicator member and one of the block members contain fluid passageways, the passageways can be connected in series.

In one of its more preferred embodiments, the apparatus of this invention comprises means for pressurizing and deprssurizing the reservoir, the means for depressurizing being responsive to a signal indicating the cessation of passage of the strand in contact with the applicator member.

In another of its more preferred embodiments the apparatus of this invention comprises a flushing means adapted to flush the size from the applicator, the flushing means being activated in response to a signal indicating the stoppage of a rotary member for advancing the strand. The flushing means can be comprised of a nozzle for directing the flushing fluid to the applicator surface.

In the most preferred embodiment of this invention, an inlet conduit is adapted to direct size into the reservoir in such a manner as to prevent regions of substantially stagnant size within the reservoir. The reservoir can be of a configuration to avoid creation of regions of substantially stagnant size therein.

This invention will be more fully understood by reference to the drawings, in which FIG. 1 is an isometric view of a size applicator according to this invention.

Figure 2:
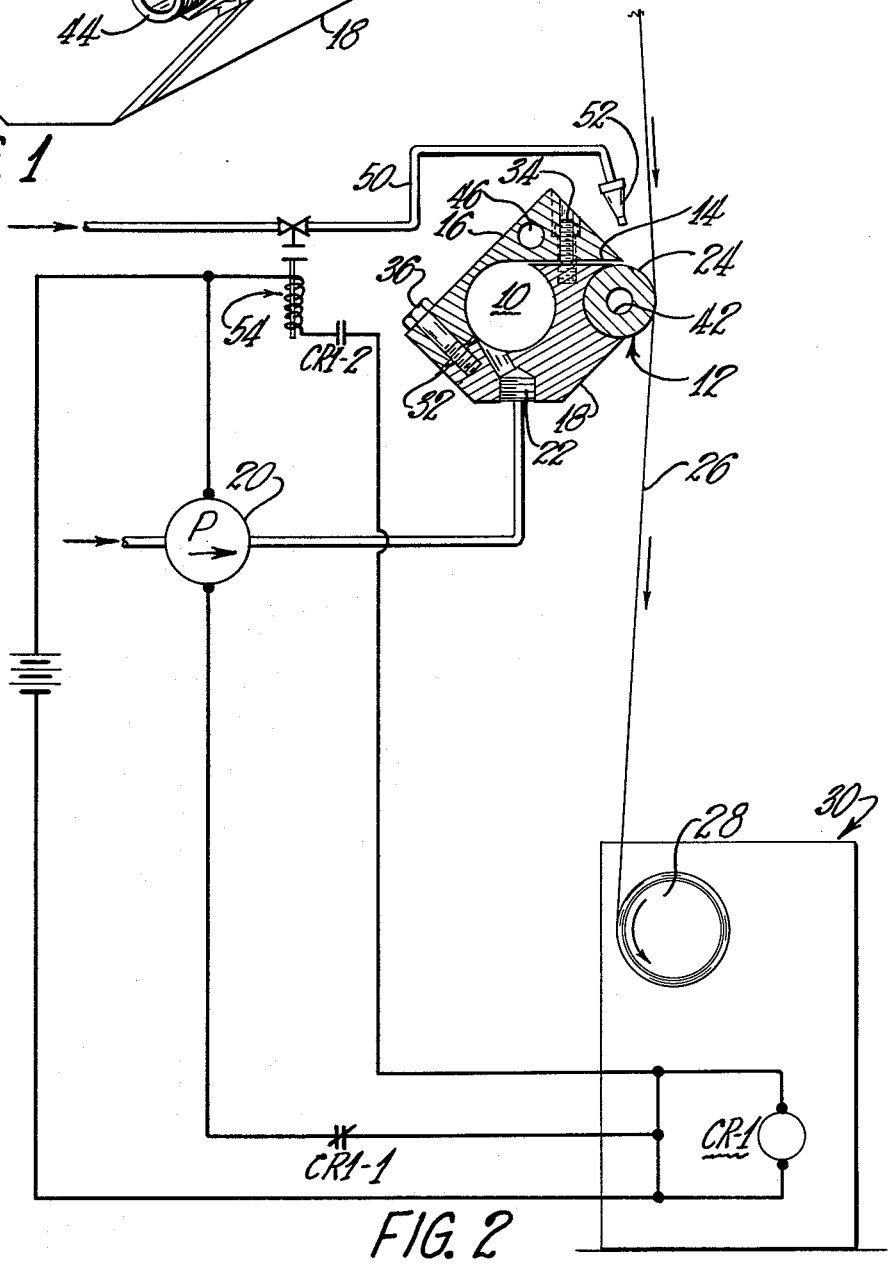

FIG. 2 is a cross-sectional view of the size applicator of FIG. 1 with a schematic illustration of apparatus for pressurizing the reservoir and for flushing the applicator surface.

Referring now to these figures there is shown reservoir 10 for storing the size, applicator member 12, condit 14 and top and bottom block members 16 and 18, respectively. The applicator member can be non-rotational member. During normal operation of the size applicator pump 20 pressurizes the reservoir through inlet conduit 22 and the size is forced out from the pressurized reservoir through the conduit as a film onto applicator surface 24 of the applicator member. Strand 26 contacts the applicator surface, becomes coated with the size and then is wound on rotating collet 28 of conventional winder 30. It is to be understood that the coated strand can be recovered other than by being wound into a rotating collet. For example, the strand could be fed into a strand chopper by a pull roll.

The top and bottom block members are separated by gasket 32 and set screw means 34, which is mounted in the top block member. The separation between the two opposed block members, as determined by the set screw means, defines the conduit. By adjusting the set screw means, the distance between the two opposed block members is altered, and thus the configuration of the conduit is altered. This altering of the configuration of the conduit alters the thickness of the film of size deposited on the applicator surface. Specifically, by screwing the set screw downwardly, the set screw projects farther from the top block member, and results in an increase in the distance between the top and bottom block members. Such an altering of the configuration of the conduit results in an increase in the thickness of the film of size laid onto the applicator surface.

Bolt members 36 are adapted to urge the block members toward each other. End plates 38 and gaskets 40 seal the end of the reservoir and the conduit.

Passageway 42 is positioned within the applicator member for the passage therethrough of a temperature-controlling fluid. The passage of such a fluid through the member enables holding the applicator surface at a steady temperature, this being difficult to achieve in those strand sizing operations having such temperature-affecting conditions as hot down drafts of air entrained with the strand and relatively cool variable drafts of conditioned air. Maintaining the applicator surface temperature steady maintains the viscosity of the size constant, and thereby provides a uniformly coated strand. The applicator passageway is adapted with members 44 for hose connections to a fluid supply.

The temperature of one or both of the block members can be maintained by the passage of a temperature-controlling fluid through passageway 46, as shown in the top block member. This passageway is adapted with members 48 for hose connections to a fluid supply. The fluid passageways of the applicator member and the block members can be connected in series.

In the event that the strand ceases to be wound for any reason, the control apparatus will turn off the pump and thereby depressurize the reservoir and stop the flow of size through the conduit and onto the applicator surface. The stopping of the collet activates control relay CR1, which opens contact CR1-1, which is normally closed. Opening the contact cuts off the power to the pump, and the force pressurizing the reservoir is eliminated. When the collet is started again, control relay CR1 is deactivated, contact CR1-1 returns to its normally closed position, and the pump is started.

Supply hose 50 is adapted with nozzle 52 to spray a flushing fluid onto the applicator surface as desired. The fluid is supplied from a supply source, not shown. The application of the fluid to the applicator surface provides a lubrication function in the event that the strand is still passing in contact with the applicator surface. When the collet stops rotating, the control apparatus will turn on the flow of flushing fluid by opening solenoid valve 54, which is normally closed. The stopping of the collet activates control relay CR1. This closes contact CR1-2, which is normally open. The closed circuit opens the solenoid valve, causing the flushing fluid to be discharged from the nozzle. When the collet is started again, control relay CR1 is deactivated, contact CR1-2 is returned to its normally open position and the solenoid valve closes to stop the flow of flushing fluid.

As shown, the inlet conduit is deliberately placed off-center from the vertical centerline of the reservoir. This configuration assures a size flow pattern which has no pockets of substantially stagnant size. Other configurations obtaining the same result are possible. It is preferred that the reservoir have a flow pattern which does not have stagnant regions. Likewise, it is preferred that the conduit have no regions of stagnation.

It will be evident that various modifications can be made to this invention. Such, however, are considered as being within the scope of this invention.

We claim:

1. Apparatus for applying a size to a strand comprising:

(a) a reservoir for storing said size;

(b) an applicator member having a surface upon which said strand contacts said size, said applicator member being a non-rotational member;

(c) conduit means adapted to deliver said size from said reservoir to the applicator surface as a film, said conduit means being defined by the opening of two opposed block members, and the configuration of said conduit means being alterable by altering the distance between said two opposed block members; and, (d) a passageway in each of said block members for the passage of a temperature-controlling fluid, said passageways being connected in series.

2. The apparatus of claim 1 comprising a pump means adapted to pressurize said reservoir, and means for depressurizing said reservoir, said means for depressurizing being responsive to a signal indicating the cessation of passage of said strand in contact with said applicator member.

3. The apparatus of claim 2 wherein a flushing means responsive to said signal is adapted to flush said size from said applicator.

4. The apparatus of claim 3 wherein said flushing means comprises a nozzle for directing said fluid to said applicator surface.

5. Apparatus for applying a size to a strand comprising:

(a) a reservoir for storing said size;

(b) an applicator member having a surface upon which said strand contacts said size;

(c) conduit means adapted to deliver said size from said reservoir to the applicator surface as a film, said conduit means being defined by the opening between two opposed block members, and the configuration of said conduit means being alterable by altering the distance between said two opposed block members;

(d) a passageway in each of said block members for the passage of a temperature-controlling fluid; and, (e) a passageway in said applicator member for the passage of a temperature-controlling fluid, the applicator passageway being connected in series with the fluid passageway in one of said opposed block members.

* * * * *